US009075352B2

(12) United States Patent
Seki et al.

(10) Patent No.: US 9,075,352 B2
(45) Date of Patent: Jul. 7, 2015

(54) IMAGE FORMING APPARATUS INCLUDING REMOVAL UNIT FOR REMOVING DEVELOPER

(71) Applicant: CANON KABUSHIKI KAISHA, Tokyo (JP)

(72) Inventors: Hiroyuki Seki, Numazu (JP); Takaaki Tsuruya, Mishima (JP); Yasutaka Yagi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/096,060

(22) Filed: Dec. 4, 2013

(65) Prior Publication Data

US 2014/0169813 A1 Jun. 19, 2014

(30) Foreign Application Priority Data

Dec. 17, 2012 (JP) ..... 2012-275097

(51) Int. Cl.
*G03G 15/00* (2006.01)
*G03G 21/00* (2006.01)
*G03G 15/16* (2006.01)

(52) U.S. Cl.
CPC ..... *G03G 15/161* (2013.01); *G03G 21/0041* (2013.01)

(58) Field of Classification Search
CPC ..... G03G 21/0005; G03G 21/0041; G03G 21/0094; G03G 2221/0005
USPC ..... 399/45, 53, 71, 101, 343, 346
See application file for complete search history.

(56) References Cited

U.S. PATENT DOCUMENTS

| | | | | |
|---|---|---|---|---|
| 5,970,282 | A * | 10/1999 | Yanagida et al. | 399/101 |
| 6,856,772 | B2 | 2/2005 | Bessho et al. | |
| 2003/0206746 | A1 | 11/2003 | Bessho et al. | |
| 2011/0222885 | A1 * | 9/2011 | Yamaki et al. | 399/101 X |

FOREIGN PATENT DOCUMENTS

| | | | |
|---|---|---|---|
| JP | 2004-126506 | A | 4/2004 |
| JP | 2007-079126 | A | 3/2007 |
| JP | 2010-128401 | A | 6/2010 |
| JP | 2011-064741 | A | 3/2011 |
| JP | 2012-194513 | A | 10/2012 |

* cited by examiner

*Primary Examiner* — Sophia S Chen
(74) *Attorney, Agent, or Firm* — Fitzpatrick, Cella, Harper & Scinto

(57) ABSTRACT

An image forming apparatus includes a removal unit configured to remove developer that was not transferred to a recording material; and a control unit configured to control an image forming unit for supplying developer to the removal unit. The image forming unit is configured to form first developer image, and second developer image whose length in the sub-scanning direction is longer than that of the first developer image, and whose amount of developer per unit area is less than or equal to that of the first developer image, and the control unit is further configured to, based on a predetermined relationship between the recording material type and the supplying image, select a supplying image formed by the image forming unit before or after the developer image transferred to the recording material.

16 Claims, 13 Drawing Sheets

FIG. 5

| RECORDING MATERIAL TYPE | GRAMMAGE ($g/m^2$) | PROCESS SPEED (mm/s) | PRODUCTIVITY (SHEETS/MINUTE) | NON-FORMING REGION LENGTH (mm) |
|---|---|---|---|---|
| REGULAR PAPER | AT OR ABOVE 75, LESS THAN 90 | 240 | 40 | 40 |
| THICK PAPER #1 | AT OR ABOVE 90, LESS THAN 120 | 120 | 20 | 80 |
| THICK PAPER #2 | AT OR ABOVE 120, LESS THAN 216 | 80 | 13 | 120 |
| GLOSSY PAPER #1 | LESS THAN 160 | 120 | 20 | 80 |
| GLOSSY PAPER #2 | AT OR ABOVE 160, LESS THAN 220 | 60 | 10 | 160 |
| SMALL-SIZED PAPER | LESS THAN B5 SIZE | 120 | 20 | 80 |

| | AMOUNT OF TONER PER UNIT AREA (mg/cm$^2$) | CLEANING | AMOUNT OF UNDERSIDE SMEARING (%) |
|---|---|---|---|
| CONDITION #1 | 0.00 | NOT OK: CURLING OCCURRED | 0.2 |
| CONDITION #2 | 0.02 | NOT OK: CLEANING DEFECT OCCURRED | 0.6 |
| CONDITION #3 | 0.04 | OK | 1.2 |
| CONDITION #4 | 0.08 | OK | 2.0 |
| CONDITION #5 | 0.10 | OK | 2.5 |

FIG. 9

| | LENGTH IN SUB-SCANNING DIRECTION (mm) | AMOUNT OF TONER PER UNIT AREA ($mg/cm^2$) | SUPPLY TONER AMOUNT (mg) | CLEANING | AMOUNT OF UNDERSIDE SMEARING (%) |
|---|---|---|---|---|---|
| CONDITION #6 | 4 | 0.04 | 0.35 | OK | 1.2 |
| CONDITION #7 | 8 | 0.04 | 0.70 | OK | 1.2 |
| CONDITION #8 | 8 | 0.02 | 0.35 | OK | 0.6 |
| CONDITION #9 | 12 | 0.013 | 0.35 | OK | 0.5 |

FIG. 10

| RECORDING MATERIAL TYPE | LENGTH OF NON-FORMING REGION (mm) | LENGTH IN SUB-SCANNING DIRECTION OF SUPPLYING TONER IMAGE (mm) | AMOUNT OF TONER PER UNIT AREA ($mg/cm^2$) | SUPPLY TONER AMOUNT (mg) | AMOUNT OF UNDERSIDE SMEARING (%) |
|---|---|---|---|---|---|
| REGULAR PAPER | 40 | 4 | 0.04 | 0.35 | 1.2 |
| THICK PAPER #1 | 80 | 8 | 0.02 | 0.35 | 0.6 |
| THICK PAPER #2 | 120 | 12 | 0.013 | 0.35 | 0.5 |
| GLOSSY PAPER #1 | 80 | 8 | 0.02 | 0.35 | 0.6 |
| GLOSSY PAPER #2 | 160 | 16 | 0.01 | 0.35 | 0.4 |
| SMALL-SIZED PAPER | 80 | 8 | 0.02 | 0.35 | 0.4 |

| MODE | RECORDING MATERIAL TYPE | LENGTH IN SUB-SCANNING DIRECTION OF SUPPLYING TONER IMAGE (mm) | AMOUNT OF TONER PER UNIT AREA ($mg/cm^2$) | SUPPLY TONER AMOUNT (mg) | AMOUNT OF UNDERSIDE SMEARING (%) |
|---|---|---|---|---|---|
| FIRST | REGULAR PAPER | 4 | 0.04 | 0.35 | 1.2 |
| SECOND | OTHER THAN REGULAR PAPER | 10 | 0.02 | 0.44 | 0.2 |
| THIRD | REGULAR PAPER | 4 | 0.02 | 0.18 | 0.2 |

FIG. 14

| MODE | RECORDING MATERIAL TYPE | LENGTH OF NON-FORMING REGION (mm) | LENGTH IN SUB-SCANNING DIRECTION OF SUPPLYING TONER IMAGE (mm) | AMOUNT OF TONER PER UNIT AREA ($mg/cm^2$) | SUPPLY TONER AMOUNT (mg) | AMOUNT OF UNDERSIDE SMEARING (%) |
|---|---|---|---|---|---|---|
| REGULAR | REGULAR PAPER | 40 | 4 | 0.04 | 0.35 | 1.2 |
| | THICK PAPER #1 | 80 | 8 | 0.02 | 0.70 | 0.6 |
| | THICK PAPER #2 | 120 | 12 | 0.013 | 0.35 | 0.5 |
| | GLOSSY PAPER #1 | 80 | 8 | 0.02 | 0.35 | 0.6 |
| | GLOSSY PAPER #2 | 160 | 16 | 0.01 | 0.35 | 0.4 |
| | SMALL-SIZED PAPER | 80 | 8 | 0.02 | 0.35 | 0.4 |
| SUPPLY INCREASE | ALL TYPES | 80 | 8 | 0.04 | 0.70 | 1.2 |

FIG. 17

| MODE | RECORDING MATERIAL TYPE | LENGTH OF NON-FORMING REGION (mm) | LENGTH IN SUB-SCANNING DIRECTION OF SUPPLYING TONER IMAGE (mm) | AMOUNT OF TONER PER UNIT AREA ($mg/cm^2$) | SUPPLY TONER AMOUNT (mg) | DIFFERENCE IN TONER AMOUNT (mg) | AMOUNT OF UNDERSIDE SMEARING (%) |
|---|---|---|---|---|---|---|---|
| REGULAR | REGULAR PAPER | 40 | 4 | 0.04 | 0.35 | 0 | 1.2 |
| SMALL AMOUNT | REGULAR PAPER | 40 | 4 | 0.02 | 0.18 | -0.17 | 0.6 |
| REGULAR | THICK PAPER #1 | 80 | 10 | 0.02 | 0.44 | 0.09 | 0.6 |
| | THICK PAPER #2 | 120 | 20 | 0.013 | 0.59 | 0.24 | 0.5 |
| | GLOSSY PAPER #1 | 80 | 10 | 0.02 | 0.44 | 0.09 | 0.6 |
| | GLOSSY PAPER #2 | 160 | 30 | 0.01 | 0.66 | 0.31 | 0.4 |
| | SMALL-SIZED PAPER | 80 | 10 | 0.02 | 0.44 | 0.09 | 0.6 |

IMAGE FORMING APPARATUS INCLUDING REMOVAL UNIT FOR REMOVING DEVELOPER

BACKGROUND OF THE INVENTION

1. Field of the Invention

The present disclosure relates to an image forming apparatus that uses an electrophotographic recording method such as laser printer, a copier, or a facsimile, and particularly relates to image carrier cleaning.

2. Description of the Related Art

Examples of image forming apparatuses include apparatuses in which a toner image of different colors is formed on a photosensitive member, is primarily transferred to an intermediate transfer member that is an image carrier, and is subsequently secondarily transferred to a recording material. Examples of these kinds of image forming apparatus include apparatuses in which a cleaning unit is provided in order to remove remaining toner that remains on the intermediate transfer member without being transferred from the intermediate transfer unit to the recording material. A cleaning blade that is part of the cleaning unit is made of a rubber such as polyurethane, and due to the toner penetrating the edge of the blade, a lubricating effect can be demonstrated and preferable cleaning performance can be obtained.

However, if a state in which there is a small amount of toner penetrating into the edge of the cleaning blade continues, friction between the cleaning blade and the intermediate transfer member increases and a stick-slip phenomenon occurs. The stick-slip phenomenon occurs when the intermediate transfer member moves while the cleaning blade is pressed against the intermediate transfer member. Specifically, due to the friction between the cleaning blade and the intermediate transfer member, the edge of the cleaning blade deforms in the direction of movement of the intermediate transfer member (shear deformation, compression deformation). Energy that has accumulated at the edge due to this deformation functions as a restoring force (rebound elastic force), and the cleaning blade is returned to its original state. The stick-slip phenomenon is the phenomenon of repeating the deformation and the return to the original state. If this phenomenon progresses, the edge of the cleaning blade will jump, toner will slip through, and a cleaning defect will occur. Furthermore, sometimes the edge of the cleaning blade and the surface of the intermediate transfer member will be damaged. Furthermore, it is possible for the edge of the cleaning blade to be caught on the intermediate transfer member, causing the cleaning blade to curl up.

For this reason, Japanese Patent Laid-Open No. 2011-064741 discloses a configuration for preventing the occurrence of cleaning defects by supplying toner that functions as a lubricant to the cleaning blade. If toner is supplied to the cleaning blade, the toner image that has been formed on the intermediate transfer member comes into contact with a secondary transfer roller for transferring the toner image to a recording material, and accordingly, the toner is attached to the secondary transfer roller. When a recording material that is to be printed on next passes between the intermediate transfer member and the secondary transfer roller, the toner attached to the secondary transfer roller is transferred to the underside of the image forming surface of the recording material, or so to speak, smearing of the underside occurs.

Japanese Patent Laid-Open No. 2011-064741 discloses a configuration in which the secondary transfer roller is separated from the intermediate transfer member, and a configuration in which a bias is applied which has a polarity opposite to that at the time of transfer from the secondary transfer roller when a toner image comes into contact with the secondary transfer roller, in order to prevent or suppress the attachment of toner to the secondary transfer roller.

However, configurations in which the secondary transfer roller is separated from the intermediate transfer member are costly. Also, if image formation is performed repeatedly, throughput is affected due to the secondary transfer roller coming into and out of contact with the intermediate transfer member. Furthermore, an image defect can occur due to a shock at the time of contact. Additionally, even if a bias having a polarity opposite to that during the transfer from the secondary transfer roller is applied, there is a possibility that the attachment of toner to the recording material cannot be sufficiently suppressed and smearing of the underside will occur, depending on the amount of toner.

SUMMARY OF THE INVENTION

According to an aspect of the present invention, an image forming apparatus includes: an image forming unit configured to form a developer image on an image carrier using a developer; a transfer unit configured to transfer the developer image formed on the image carrier to a recording material; a removal unit configured to remove developer that was not transferred to the recording material and remains on the image carrier; and a control unit configured to, in order to supply developer to the removal unit, control the image forming unit such that a supplying developer image that is not to be transferred to the recording material is formed on a region of the image carrier that is between developer images that are to be transferred to the recording material. The image forming unit is configured to be able to form at least one first supplying developer image, and at least one second supplying developer image whose length in the sub-scanning direction is longer than that of the first supplying developer image, and whose amount of developer per unit area is less than or equal to the amount of developer per unit area of the first supplying developer image, and the control unit is further configured to, based on a predetermined relationship between the recording material type and the supplying developer image, select a supplying developer image that is to be formed by the image forming unit before or after the developer image that is to be transferred to the recording material.

Further features of the present invention will become apparent from the following description of exemplary embodiments with reference to the attached drawings.

BRIEF DESCRIPTION OF THE DRAWINGS

FIG. 5 is a diagram showing settings for various types of recording materials according to an embodiment.

FIGS. 8A, 8B-1 to 8B-3, and 8C-1 to 8C-3 are diagrams showing supplying toner images according to an embodiment.

FIG. 9 is a diagram showing relationships between amounts of toner per unit area, cleaning performance, and amounts of underside smearing according to an embodiment.

FIG. 10 is a diagram showing supplying toner images used on recording materials according to an embodiment.

FIG. 14 is a diagram showing relationships between modes, recording material types, and supplying toner images according to an embodiment.

FIG. 17 is a diagram showing relationships between modes, recording material types, and supplying toner images according to an embodiment.

DESCRIPTION OF THE EMBODIMENTS

Below, exemplary embodiments of the present invention will be described with reference to the accompanying drawings. Note that constituent elements that are not needed in the description of the embodiments are not included in the figures described below.

First Embodiment

Figure 2:
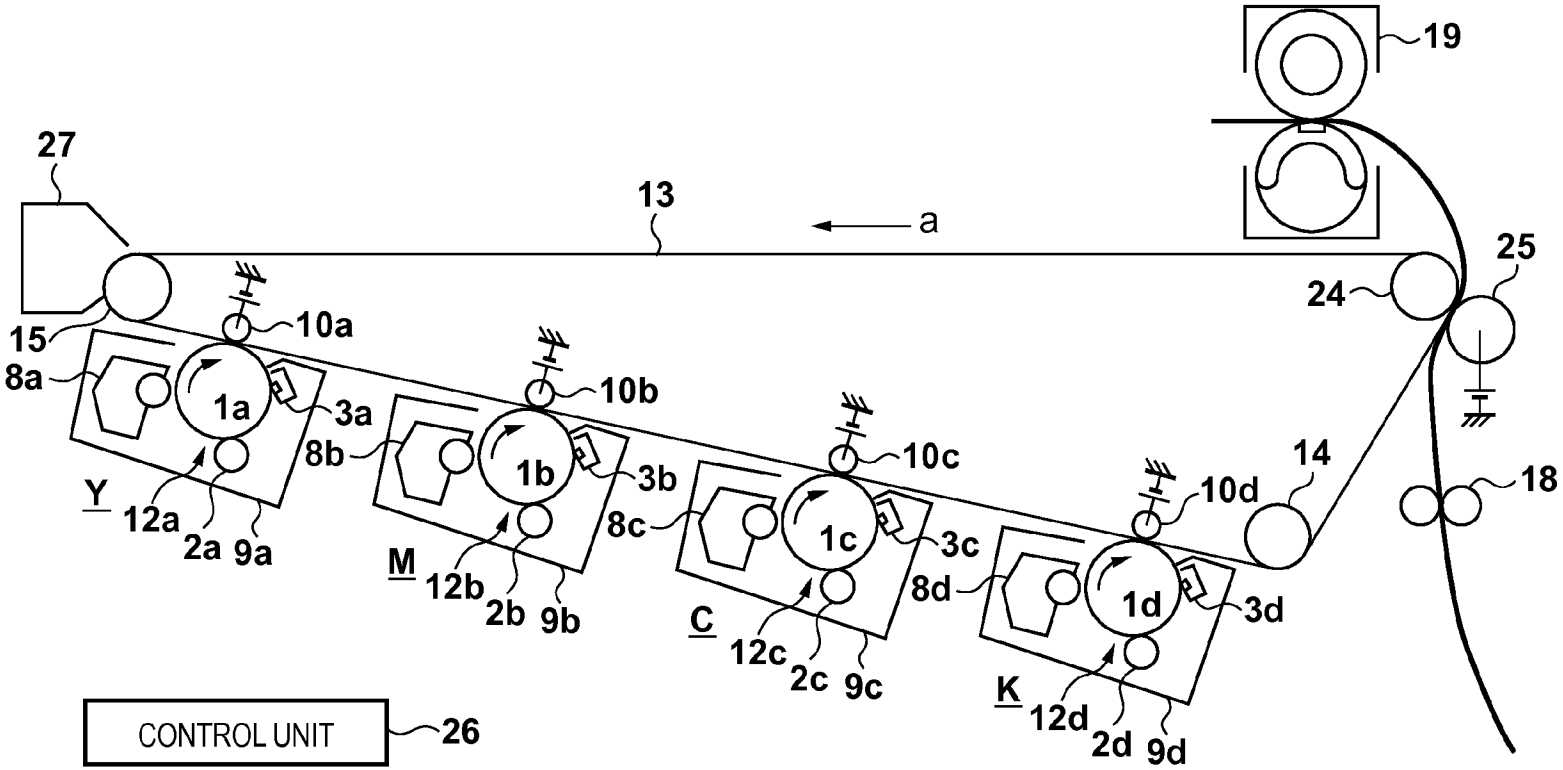
FIG. 2 is a schematic configuration diagram showing an image forming apparatus according to an embodiment.

FIG. 2 is a schematic configuration diagram showing an image forming apparatus according to the present embodiment. A control unit 26 performs overall control of an image forming apparatus and includes a CPU and a storage unit such as a memory. A charging unit 2*a* charges the surface of a photosensitive member 1*a* that is rotated in the direction of the arrow, an exposure unit (not shown) exposes the surface of the photosensitive member 1*a* to light 12*a* and an electrostatic latent image is formed. A developing unit 8*a* holds yellow toner Y (developer), develops the electrostatic latent image on the photosensitive member 1*a* using the toner, and creates a toner image (developer image). The toner image of the photosensitive member 1*a* is transferred to an intermediate transfer member 13 by means of a primary transfer bias applied by a primary transfer roller 10*a*. Also, a cleaning unit 3*a* removes toner that was not transferred to the intermediate transfer member 13 and remains on the photosensitive member 1*a*. In the present embodiment, the photosensitive member 1*a*, the charging unit 2*a*, the cleaning unit 3*a*, and the developing unit 8*a* constitute an integrated process cartridge 9*a*. Note that process cartridges 9*b*, 9*c*, and 9*d*, and primary transfer rollers 10*b*, 10*c*, and 10*d* form magenta M, cyan C, and black toner K images respectively on the intermediate transfer member 13. Note that the operations of the charging units 2*b*, 2*c*, and 2*d*, the cleaning units 3*b*, 3*c*, and 3*d*, the process cartridges 9*b*, 9*c*, and 9*d*, the primary transfer rollers 10*b*, 10*c*, and 10*d*, and light 12*b*, 12*c*, and 12*d* are similar to those of the charging unit 2*a*, the cleaning unit 3*a*, the process cartridge 9*a*, the primary transfer roller 10*a*, and light 12*a*, and therefore the description will not be repeated.

An intermediate transfer member 13, which is an image carrier, is supported by three rollers, namely a support roller 24, a driving roller 14, and a tension roller 15, and the appropriate tension is maintained. Due to the driving roller 14 being driven, the intermediate transfer member 13 rotates in the direction of the arrow a in the drawing, and the toner images of the photosensitive members 1*a* to 1*d* are transferred to the intermediate transfer member 13. At this time, a color image is formed by overlaying the toner images of the photosensitive members 1*a* to 1*d*, for example, and transferring them to the intermediate transfer member 13.

Figure 3:
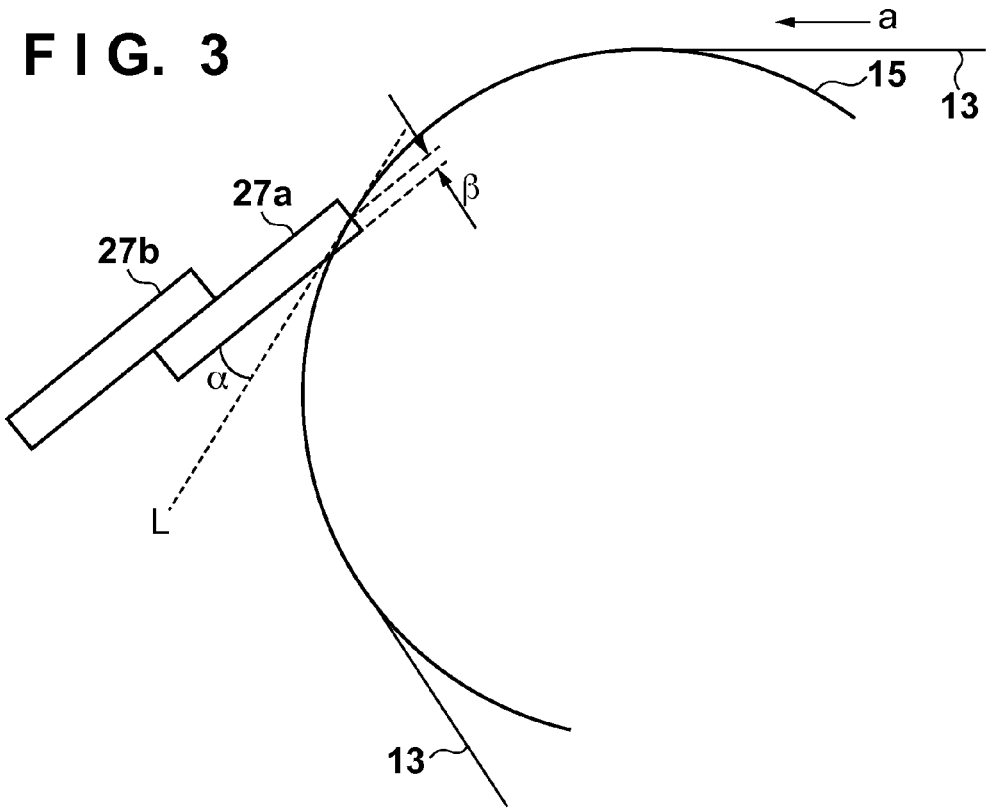
FIG. 3 is an enlarged view of a cleaning blade according to an embodiment.

The recording material that is transported by a roller 18 is transported to a nip unit between the intermediate transfer member 13 and a secondary transfer roller 25, the secondary transfer roller 25 applies a secondary transfer bias that has a polarity opposite to that of the toner, and the toner image of the intermediate transfer member 13 is transferred to the recording material. In a fixing unit 19, the toner image is fixed to the recording material onto which the toner image was transferred. Remaining toner that was not transferred from the intermediate transfer member 13 to the recording material and remains on the intermediate transfer member 13 is removed or recovered from the surface by a cleaning unit 27, which is arranged in contact with the intermediate transfer member 13. An elastic cleaning blade made of urethane, for example, can be used as the cleaning unit 27. FIG. 3 shows the state of a portion at which the cleaning unit 27 and the intermediate transfer member 13 of the present embodiment come into contact. The cleaning unit 27 includes a metal plate 27*b*, and a tip portion 27*a* made of polyurethane rubber having a free length of 8.0 mm, a thickness of 2.0 mm, and a Wallace hardness of 69 degrees, and which is attached to the tip of the metal plate 27*b*, for example.

The tip portion 27*a* is fixed so as to satisfy a predetermined setting angle $\alpha$ and a penetration amount $\beta$ with respect to the tension roller 15 that creates tension in the intermediate transfer member 13. Note that the setting angle $\alpha$ is the angle defined by the underside of the tip portion 27*a* and a tangent L at the intersection of the tip portion 27*a* and the tension roller 15 in the case where it is assumed that the tip portion 27*a* has penetrated the tension roller 15 without being deformed. On the other hand, the penetration amount $\beta$ is the distance between the point at which the tip portion 27*a* and the tension roller 15 intersect and the edge portion of the tip portion 27*a* that has penetrated the tension roller 15. For example, the setting angle $\alpha$ is 22° and the penetration amount $\beta$ can be set to 0.2 mm.

Figure 4:
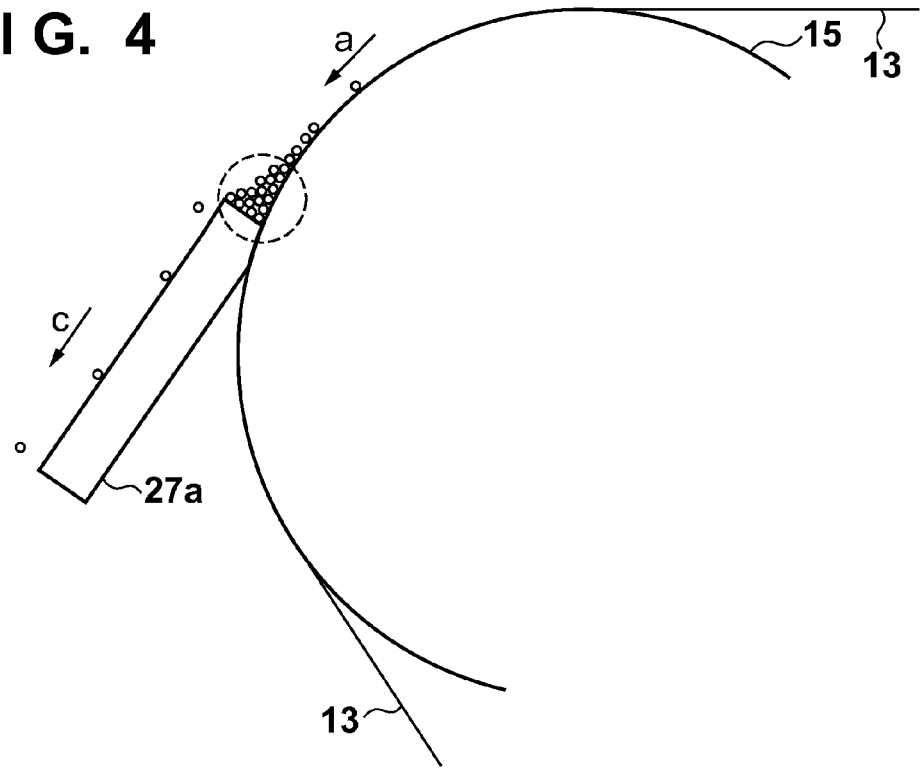
FIG. 4 is a diagram illustrating cleaning performed by the cleaning blade.

FIG. 4 shows a state in which the cleaning unit 27 is scraping off toner. The toner on the intermediate transfer member 13 is scraped off by the tip portion 27*a* in accordance with the rotation direction a of the intermediate transfer member 13, and accumulates at the region of contact between the tip portion 27*a* and the intermediate transfer member 13. The toner that has accumulated at the region of contact subsequently falls in the direction indicated by arrow c and is recovered by a recovery container. The toner that has accumulated at the region of contact between the tip portion 27*a* and the intermediate transfer member 13 functions as a lubricant for the tip portion 27*a* to obtain lubricity with respect to the surface of the intermediate transfer member 13.

As described above, if toner has accumulated at the region of contact between the tip portion 27*a* and the intermediate transfer member 13, it is possible to maintain lubricity between the cleaning unit 27 and the intermediate transfer member 13. On the other hand, if a state continues in which there is only a small amount of remaining toner, the amount of toner at the region of contact between the tip portion 27*a* and the intermediate transfer member 13 decreases, and it is not possible to maintain a favorable lubricity between the intermediate transfer member 13 and the cleaning unit 27. By executing a later-described toner supply mode in the present embodiment, toner is supplied to the region of contact between the cleaning unit 27 and the intermediate transfer member 13, and thereby a favorable lubricity is maintained.

For example, as the toner, it is possible to use a single-component non-magnetic toner whose particles are substantially spherical and have a diameter of 5 to 8 μm, to which an external additive has been added in order to stabilize charging performance and provide lubricity, the toner being manufactured by polymerization. However, it is also possible to use a double-component toner or a magnetic toner.

Figure 1:
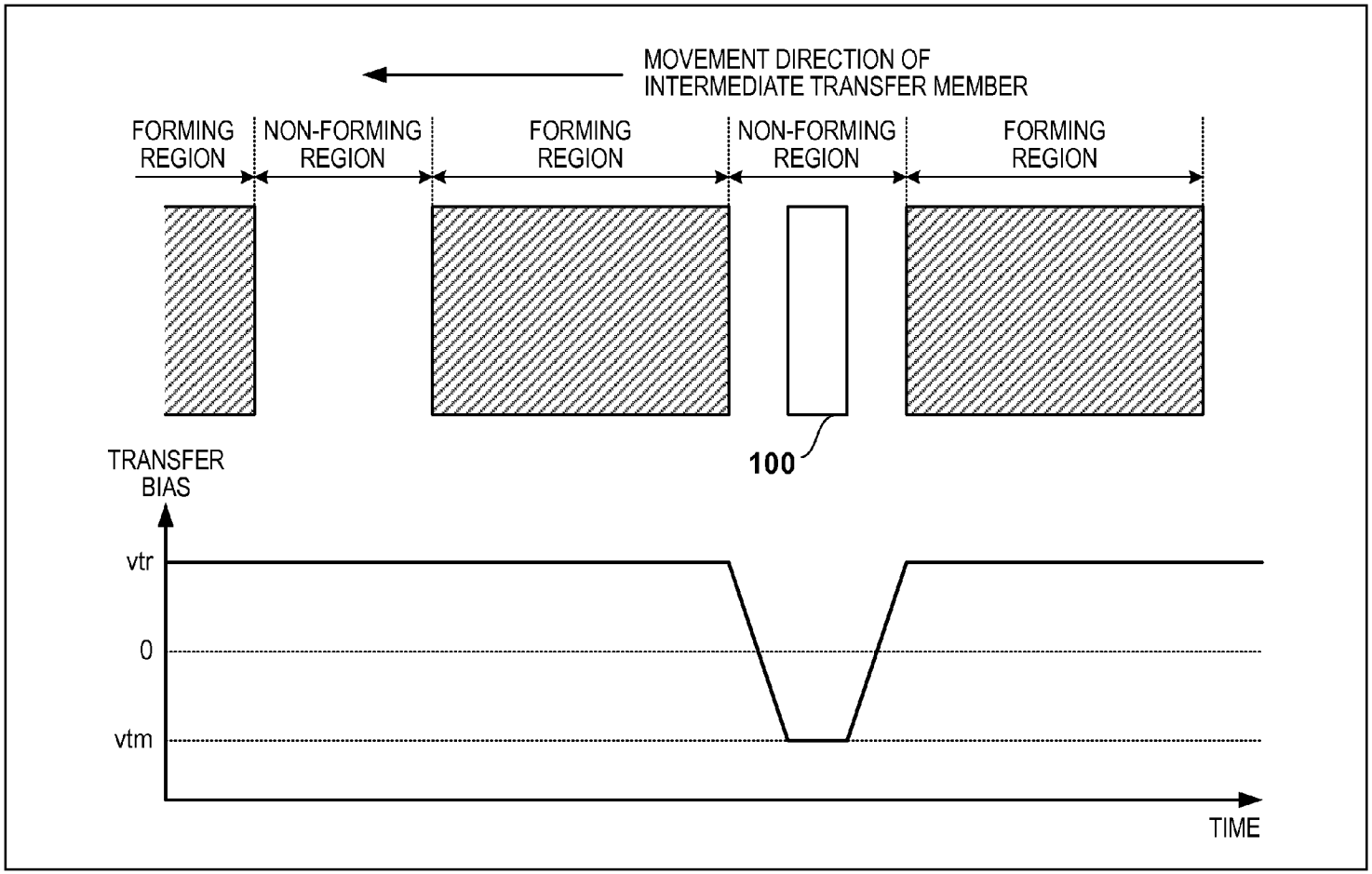
FIG. 1 is a diagram showing a secondary transfer bias during image formation and in a toner supply mode, according to an embodiment.

An operation in the toner supply mode of the present embodiment will be described next with reference to FIG. 1. Below, a toner image that is formed on the intermediate transfer member 13 in the toner supply mode will be referred to as a supplying toner image (supplying developer image). In FIG. 1, a "forming region" is a region on the intermediate transfer member 13 on which a toner image to be printed is formed, and a "non-forming region" is a region that is between forming regions on the intermediate transfer member 13. FIG. 1 shows a relationship between a supplying toner image 100 and a secondary transfer bias applied by the secondary transfer roller 25, in the case where three images are printed in succession. In the present embodiment, the toner supply mode is executed and a supplying toner image is formed on a non-forming region that is between forming regions in order to prevent a reduction in the productivity of the image forming apparatus.

FIG. 5 shows relationships between process speed, productivity, and non-forming region length with respect to recording material type and paper weight (grammage) in the present embodiment. Note that "process speed" is the movement speed of the surface of the intermediate transfer member 13, and "productivity" is the number of print pages per unit time (1 minute in the present example). Also, "non-forming region length" is the length in the movement direction of the surface of the intermediate transfer member 13, or in other words, the sub-scanning direction. Note that "length" will refer to the length in the sub-scanning direction unless stated otherwise below. As shown in FIG. 5, the length of the non-forming region increases as the grammage increases in the present embodiment. Although the toner supply mode is executed in non-forming regions in the present embodiment, the sizes of the non-forming regions are not changed for the toner supply mode, and therefore executing the toner supply mode causes no reduction in the productivity of the image forming apparatus. Note that the length in the main scanning direction of the supplying toner image 100 may be the longest length at which formation is possible. Note that the main scanning direction is the direction perpendicular to the movement direction of the surface of the intermediate transfer member 13. This is because toner is supplied uniformly to the entire region of contact between the cleaning unit 27 and the intermediate transfer member 13.

As shown in FIG. 1, the secondary transfer roller 25 applies the secondary transfer bias Vtr to forming regions as well as to non-forming regions in which the supplying toner image 100 is not formed. On the other hand, when a non-forming region in which the supplying toner image 100 has been formed comes into contact with the secondary transfer roller 25, the secondary transfer roller 25 applies a secondary transfer bias Vtm having the same polarity as the toner, and thereby suppresses the attachment of the toner of the supplying toner image 100 to the secondary transfer roller 25. However, even if the secondary transfer roller 25 applies a bias having the same polarity as the toner, a certain amount of toner will attach to the secondary transfer roller 25, and the toner that is attached to the secondary transfer roller 25 will subsequently attach to the recording material, causing underside smearing.

Figures 6, 7:
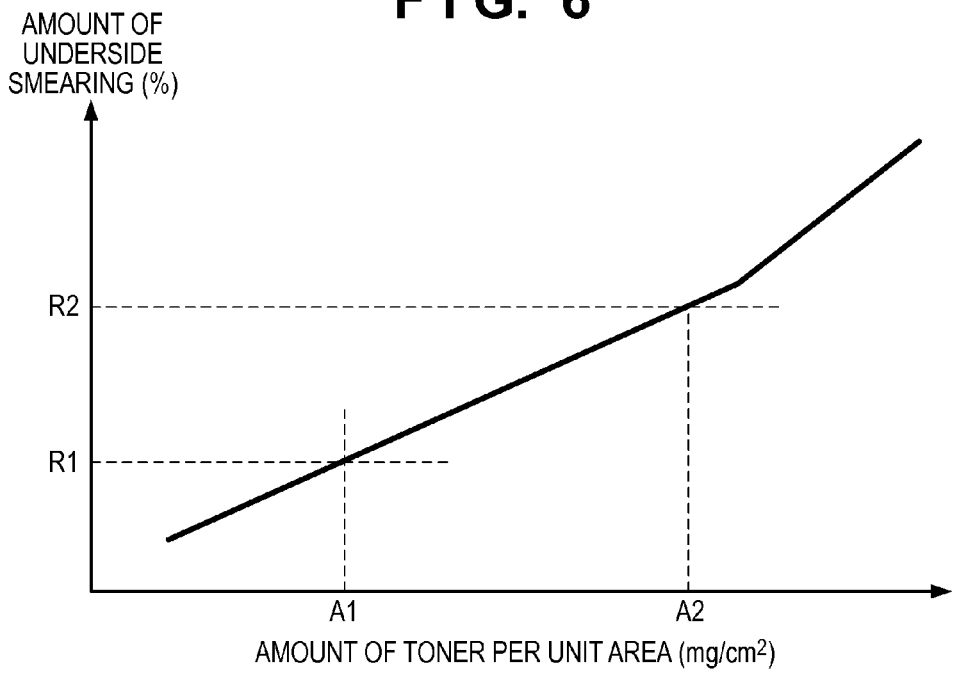
FIG. 6 is a diagram showing a relationship between amount of toner per unit area and amount of smearing of the underside according to an embodiment.
FIG. 7 is a diagram showing relationships between amounts of toner per unit area, cleaning performance, and amounts of underside smearing according to an embodiment.

FIG. 6 shows a relationship between the amount of toner per unit area and the amount of underside smearing when the tone of the supplying toner image 100 is changed. Note that in the present embodiment, the amount of underside smearing is considered to be the rate of reduction in an amount of reflected light from the recording material and is defined by equation (1) below.

$$\text{Amount of underside smearing (\%)} = ((RC - RD) * 100) / RC \quad (1)$$

Here, RC is the amount of reflected light from portions at which no underside smearing has occurred on the recording material, and RD is the amount of reflected light from portions at which underside smearing has occurred on the recording material. Note that a white light photometer TC-6DS/A manufactured by Tokyo Denshoku Co. Ltd. was used to measure the amount of reflected light, and CS-814 manufactured by Canon Inc. was used as the recording material. R2 in FIG. 6 is 2%, and R1 is 1%. In FIG. 6, amounts of underside smearing that are less than or equal to R2 were almost undetectable, and smearing that is less than or equal to R1 could not be visually confirmed. There is a correlation between the amount of toner (amount of developer) per unit area (for example, A1) of the toner image formed on the intermediate transfer member 13 and the amount of underside smearing (for example, R1), and if the amount of toner per unit area is A2 or more, the amount of underside smearing is R2 or more. This is because if the tone of a halftone image is raised, the toner coverage factor of the toner per unit area on the intermediate transfer member 13 increases, and the amount of toner coming into contact with the secondary transfer roller 25 increases.

Figure 8A:
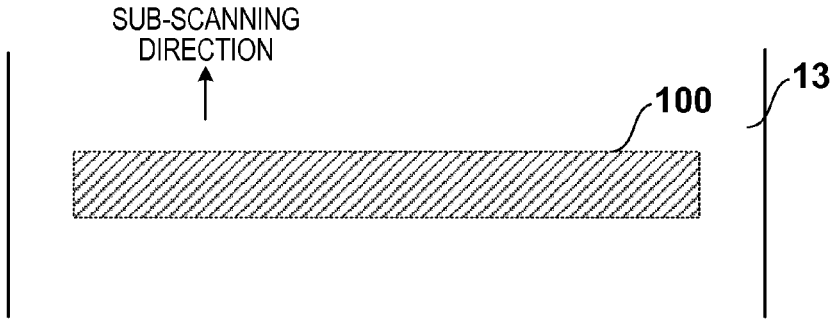
Figures 1, 8B:
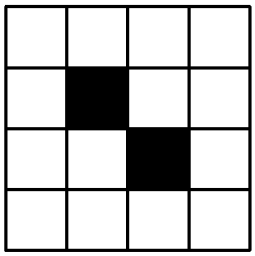
Figures 2, 8B:
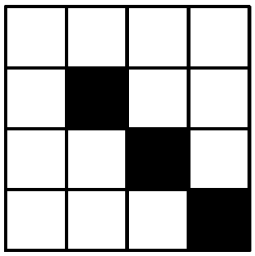
Figures 3, 8B:
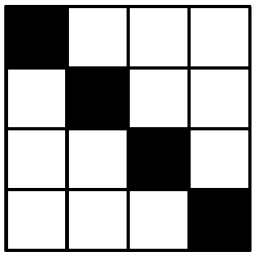
Figures 1, 8C:
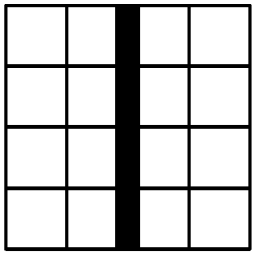
Figures 2, 8C:
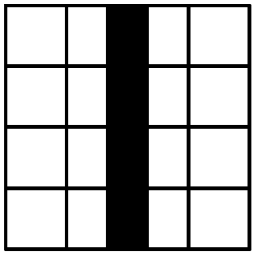
Figures 3, 8C:
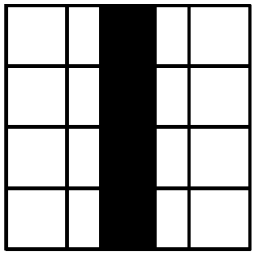

A relationship between the supply toner amount and cleaning performance will be described next. FIG. 7 shows the results of evaluating the cleaning performance and the amount of underside smearing after changing the amount of toner per unit area of the supplying toner image 100. Note that the evaluation was performed in a high-temperature, high-humidity environment having a temperature of 30° C. and a relative humidity of 80%. The recording material that was used was the CS-814 manufactured by Canon Inc., and 100 thousand pages thereof underwent two-page intermittent printing at a print percentage of 1%, and the presence of cleaning defects and the amount of underside smearing were measured. Note that the print ratio is the ratio of the area of the toner image that was actually formed with respect to the greatest area of the toner image that was formable on the recording material. Note that the supplying toner image 100 was formed in all non-forming regions, the length in the sub-scanning direction of the supplying toner image 100 was 8 mm, and the supply toner amount was adjusted by changing the tone of the halftone image. FIG. 8A shows the supplying toner image. In the supplying toner image, the amount of toner per unit area is adjusted by performing halftone processing using a 4×4 dither matrix, as shown in FIGS. 8B-1 to 8B-3. Note that it is also possible to adjust the amount of toner by changing the irradiation time of the scan beam using pulse width modulation (PWM) processing, as shown in FIGS. 8C-1 to 8C-3.

Condition 1 in FIG. 7 shows a case where the amount of toner per unit area is 0, or in other words, the toner supply mode is substantially not performed, 10 thousand sheets were used, and curling-up occurred in the tip portion 27*a* of the cleaning unit 27. This is because almost no toner functioning as lubricant was supplied and the frictional force between the cleaning unit 27 and the intermediate transfer member 13 increased. Note that the amount of underside smearing was 0.2%, which is less than R1 in FIG. 6, and the underside smearing was undetectable.

Under condition 2 of FIG. 7, 30 thousand pages were used and cleaning defects occurred. The tip portion 27*a* of the cleaning unit 27 was absent in places and in those places, cleaning defects occurred. The tip portion 27*a* was absent because the amount of supply toner was insufficient and because the frictional force with respect to microscopic protrusions on the surface of the intermediate transfer member 13 increased. Note that the amount of underside smearing was 0.6%, which is less than R1 in FIG. 6, and the underside smearing was undetectable.

Under condition 3 of FIG. 7, 100 thousand pages were used, no cleaning defects occurred, and favorable cleaning performance was obtained. This is because there was a sufficient amount of supply toner for achieving a lubricating effect, and the effect of reducing friction continued to be demonstrated. Note that the amount of underside smearing was 1.2%, which is less than R2 in FIG. 6, and was at a level of being almost undetectable.

Under condition 4 of FIG. 7, 100 thousand pages were used, no cleaning defects occurred, and favorable cleaning performance was obtained. Note that the amount of underside smearing was 2.0%, which is less than R2 in FIG. 6, and was at a level of being almost undetectable.

Under condition 5 of FIG. 7, 100 thousand pages were used, no cleaning defects occurred, and favorable cleaning performance was obtained. However, the amount of underside smearing was 2.5%, which was more than R2 in FIG. 6, and was at a visible level.

It is clear from the results of the above-described experiment that a supply toner amount per unit area that is at least 0.04 mg/cm$^2$ is needed in order to obtain favorable cleaning performance in the toner supply mode in the image forming apparatus of the present embodiment, for example. On the other hand, it is clear that the amount of toner per unit area must be not more than 0.08 mg/cm$^2$ in order to suppress underside smearing that appears due to the toner of a supplying toner image attaching to the recording material via the secondary transfer roller 25. Thus, it is clear that the amount of toner in the supplying toner image needs to be within a predetermined range in order to maintain the cleaning performance and prevent underside smearing. Note that the numeric values shown in FIG. 7 apply to a specific image forming apparatus and the present invention is not limited to the numeric values shown in FIG. 7.

A method of ensuring favorable cleaning performance and reducing underside smearing will be described next. The length in the sub-scanning direction of the supplying toner image is restricted to be less than or equal to the length in the sub-scanning direction of the non-image forming regions. When the amount of toner per unit area is increased simply because the length in the sub-scanning direction of the non-forming region is short, the amount of toner attached to the secondary transfer roller 25 increases, and the amount of underside smearing increases. On the other hand, if the length in the sub-scanning direction of a non-forming region is large, it is possible to increase the length in the sub-scanning direction of the supplying toner image 100, and thereby, it is possible to supply a sufficient amount of toner to the cleaning unit 27 even if the amount of toner per unit area is reduced.

FIG. 9 shows the results of evaluating the length in the sub-scanning direction of the supplying toner image 100 and the amount of underside smearing after changing the amount of toner per unit area of the supplying toner image 100. Note that the other conditions are the same as those during the measurement in FIG. 7.

The amounts of underside smearing under condition 6 and under condition 7, in which the length in the sub-scanning direction of the supplying toner image 100 was double that of condition 6, were both 1.2%. On the other hand, under condition 8, the length in the sub-scanning direction of the supplying toner image was the same as under condition 7, the amount of toner per unit area was half of that under conditions 6 and 7, and the amount of underside smearing was 0.6%. Also, under condition 9, the length in the sub-scanning direction of the supplying toner image was three times that of condition 6, the amount of toner per unit area was reduced to one-third that of condition 6, and the amount of underside smearing was 0.5%. Note that under condition 6 to condition 9, the cleaning performance of the cleaning unit was favorable.

By reducing the amount of toner per unit area in the supplying toner image 100 in the toner supply mode in this way, it is possible to suppress underside smearing to an almost undetectable level. Note that for a recording material with a high luminosity such as glossy paper, the amount of toner that is to be attached needs to be reduced as much as possible since toner smearing tends to be noticeable. In order to perform high-quality image formation with no smearing, it is important to reduce the amount of toner per unit area as much as possible while executing the toner supply mode. FIG. 10 shows lengths of non-forming regions, lengths in the sub-scanning direction of the supplying toner images, and amounts of toner per unit area, with respect to various types of recording materials. In FIG. 10, the amount of toner per unit area is adjusted such that the supply toner amount is the same each time. Note that FIG. 10 is merely an illustrative example and does not limit the present invention.

In the present embodiment, the greatest length in the sub-scanning direction of the supplying toner image is less than the circumference of the secondary transfer roller 25. This is because the toner from the supplying toner image is only given one opportunity to be attached to the surface of the secondary transfer roller 25. The outer diameter of the secondary transfer roller 25 of the present embodiment is 20 mm, and therefore the length in the sub-scanning direction of the supplying toner image is less than 62.8 mm.

Figures 11, 12:
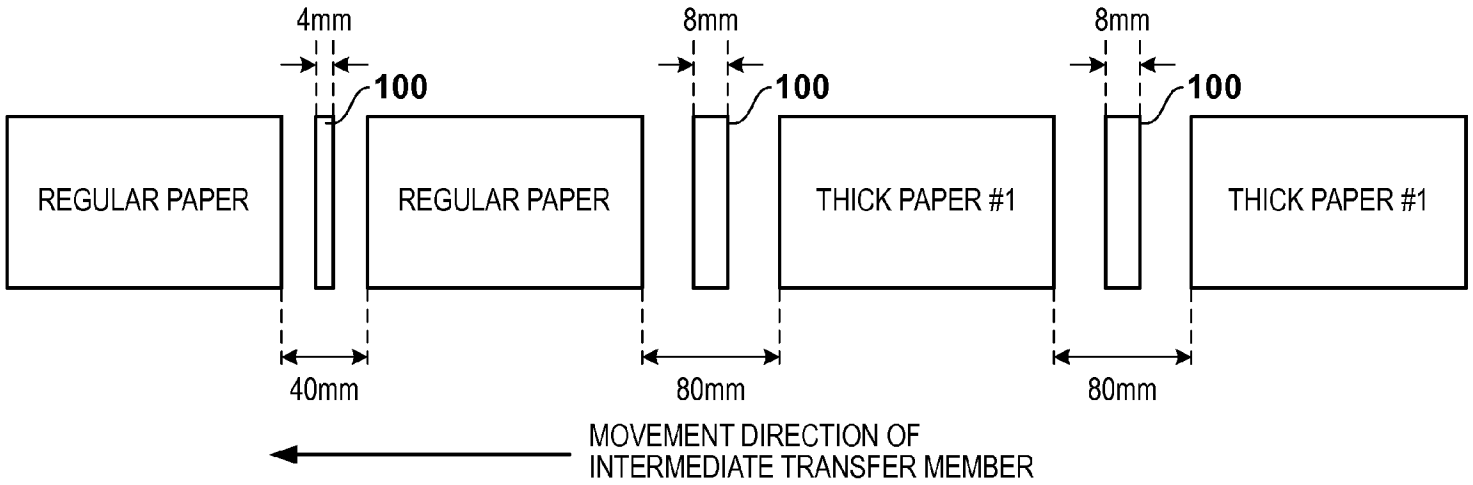
FIG. 11 is a diagram showing exemplary recording materials and supplying toner images in the case where the settings in FIG. 10 are used.
FIG. 12 is a diagram showing relationships between modes, recording material types, and supplying toner images according to an embodiment.

Note that the length of the non-forming regions, the length of the supplying toner image formed on the non-forming region, and the amount of toner per unit area in FIG. 10 are given for the upstream side, with respect to the movement direction of the intermediate transfer member 13, of the corresponding recording material. In other words, a supplying toner image that corresponds to the recording material that is to be printed on next is formed before a toner image for the recording material that is to be printed on next. Accordingly, in the settings in FIG. 10, in the case of performing printing on the recording material shown in FIG. 11, the lengths in the sub-scanning direction of the non-forming regions, and the lengths in the sub-scanning direction of the supplying toner images 100 formed on the non-forming regions are as shown in FIG. 11. In the present embodiment, a supplying toner image that corresponds to the recording material is formed before the toner image that is to be transferred to the recording material, but it is also possible to form the supplying toner image corresponding to the recording material after the toner image that is to be transferred to the recording material.

In the present embodiment and the embodiments described below, the case where the recording material is regular paper is used as a reference, and the supplying toner image that was formed in the case where the recording material is regular paper is referred to as a first supplying toner image (first supplying developer image). Also, the supplying toner image formed in the case of using a recording material other than regular paper is referred to as a second supplying toner image (second supplying developer image). As shown in FIG. 10, the lengths in the sub-scanning direction of the second supplying toner images are all longer than that of the first supplying toner image in the present embodiment. Also, the amounts of toner per unit area of the second supplying toner images are not more than the amount of toner per unit area of the first supplying toner image (not more than the amount of the developer). Note that in the present embodiment, the supply toner amount in the second supplying toner image is equal to the supply toner amount in the first supplying toner image. Furthermore, the amounts of toner per unit area of all supplying toner images are not more than a predetermined amount at which underside smearing can be prevented, and in the present embodiment, they are at most 0.04 mg/cm$^2$.

As described above, in the present embodiment, it is possible to suppress underside smearing while maintaining cleaning performance by changing the length in the sub-scanning direction and the amount of toner per unit area of the supplying toner image in accordance with the length in the sub-scanning direction of the non-forming region that is determined by the recording material to be used for printing. Note that in the present embodiment, the developing unit that supplies the toner in the toner supply mode can be selected based on any suitable criteria. In other words, the control unit 26 selects one or multiple developing units 8*a* to 8*d* based on suitable criteria, and forms the supplying toner image 100 on the intermediate transfer member 13 using the selected developing unit. For example, based on the amount of toner remaining in the developing units 8*a* to 8*d*, the control unit 26 can select one or multiple developing units. Also, the control unit 26 can select a developing unit that was used for printing on the immediately previous recording material, or a developing unit that was not used. Furthermore, a configuration is possible in which all of the developing units 8*a* to 8*d* are always selected. Additionally, the present invention can be applied to the supply of toner as a lubricant to the cleaning units 3*a* to 3*d* of each cartridge instead of to the cleaning unit 27 of the intermediate transfer member 13.

Second Embodiment

A second embodiment will be described next focusing on the differences from the first embodiment. In the present embodiment, there are three toner supply modes, namely a first mode to a third mode, as shown in FIG. 12. Here, the first mode is the same as the case of using regular paper in the first embodiment, and the supplying toner image in the first mode is the first supplying toner image. Additionally, the second mode is selected when regular paper is not used as the recording material, and the length in the sub-scanning direction of the supplying toner image is longer than that in the first mode, but the amount of toner per unit area is less than that in the first mode. Note that the supply toner amount in the second mode is greater than the supply toner amount in the first mode. In the second mode, all cases of using recording materials other than regular paper in the first embodiment have been grouped together, and the supplying toner image in the second mode is the second supplying toner image. However, in the present embodiment, unlike the first embodiment, the supply toner amount in the second supplying toner image is greater than or equal to the supply toner amount (greater than or equal to the developer amount) in the first supplying toner image. The third mode is a mode in which the size of the supplying toner image 100 is the same as in the first mode, but the amount of toner per unit area is less than that in the first mode. Accordingly, the supply toner amount in the third mode is less than the supply toner amount in the first mode.

Figure 13:
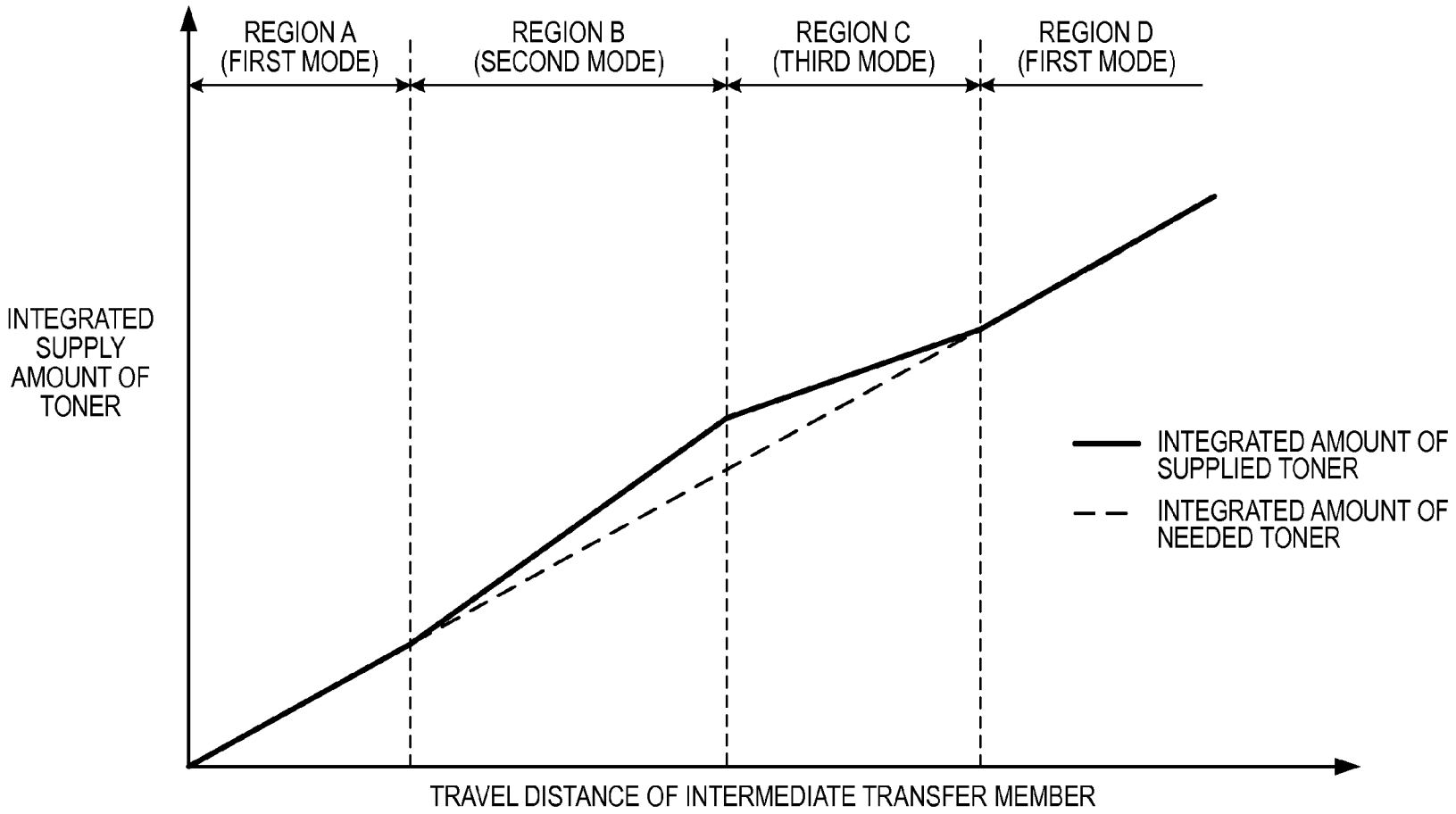
FIG. 13 is a diagram showing a relationship between an integrated amount of toner that was supplied and an integrated amount of toner that is needed with respect to travel distance of an intermediate transfer member.

A method of controlling the toner supply mode will be described next with reference to FIG. 13. Note that the toner supply mode selected at the time of image formation, the relationship between the travel distance of the intermediate transfer member and the integrated supply amount of toner that is needed, and the integrated amount of toner that has been supplied up to the current point in time are stored in the control unit 26 of the image forming apparatus. Note that in FIG. 13, the dotted line represents the relationship between the travel distance of the intermediate transfer member 13 and the integrated amount of toner that needs to be supplied to the cleaning unit 27, and the solid line represents the relationship between the travel distance of the intermediate transfer member 13 and the integrated amount of toner that has actually been supplied.

First, if regular paper has been selected for printing, the first mode is selected as the toner supply mode. At this time, the amount of underside smearing is 1.2%, as was described in the first embodiment. Given that the first mode was selected, in region A, the integrated amount of the toner that has actually been supplied matches the integrated amount of the toner that needs to be supplied. Next, if a recording material having a long non-forming region such as glossy paper, thick paper, or small-sized paper is selected during printing, the second mode is selected as the toner supply mode. In the second mode, the length in the sub-scanning direction and amount of toner per unit area of the supplying toner image are, respectively, 2.5 times and 0.5 times those of the first mode, and therefore the supply toner amount in the second mode increases compared to the regular first mode. However, in the second mode, the amount of toner per unit area is less than that of the first mode, and therefore the amount of underside smearing is 0.2%, which is lower than in the first mode. Also, due to the second mode being selected, in region B, the integrated amount of the toner that has actually been supplied is greater than the integrated amount of toner that needs to be supplied.

Next, if regular paper is once again selected during printing, the control unit 26 compares the integrated amount of toner that has been supplied at the current point in time and the integrated amount of toner that needs to be supplied. As shown in FIG. 13, at the time of ending the second mode, or in other words, at the point in time when regular paper is selected again, the integrated amount of the supplied toner exceeds the integrated amount of the needed toner, and therefore the control unit 26 selects not the first mode, but the third mode. As described above, since the amount of toner per unit area in the third mode is less than in the first mode, the amount of underside smearing can be reduced to 0.2%. The toner supply amount at this time is less than the reference, but since the toner that was sufficiently supplied in region B is in the vicinity of the cleaning unit 27, there is no deterioration in cleaning performance. While the third mode is selected, the control unit 26 compares the integrated amount of supplied toner and the integrated amount of toner that needs to be supplied and if they both match, a switch to the first mode is performed (region D). In region D, in which the first mode is selected, the integrated amount of supplied toner and the integrated amount of toner that needs to be supplied are the same.

As described above, when the length of a non-forming region is increased according to the type of recording material to be used, the toner supply amount is greater than the reference. According to this, it is possible to suppress the amount of toner per unit area of the supplying toner image when the size of the non-forming region must be reduced, and accordingly, it is possible to suppress over-consumption of toner and suppress underside smearing.

Third Embodiment

A third embodiment will be described next focusing on the differences from the first embodiment. FIG. 14 shows various conditions for various types of recording materials in the present embodiment. The difference between the present embodiment and the first embodiment is that a supply increase mode has been added. At the end of the lifetime of the process cartridges 9*a* to 9*d*, there are cases where toner lubricity is lost. In such a case, it is difficult to obtain a lubricating effect if an amount of toner that is the same as when the cartridges were first used is supplied to the cleaning unit 27. In view of this, if the amount of toner remaining on the process cartridges 9*a* to 9*d* is lower than a threshold value, it is determined that the end of the lifetime of the cartridge is near, and the supply increase mode is selected. As shown in FIG. 14, the size of the non-forming region is increased regardless of the type of recording material that is to be printed on, and control is performed such that the supply toner amount is mandatorily increased. Accordingly, although productivity falls with regular paper, it is possible to maintain the lubricating effect by supplying a sufficient amount of toner to the cleaning unit 27. Note that the supplying toner image that is formed in the supply increase mode is the second supplying toner image.

Figure 15:
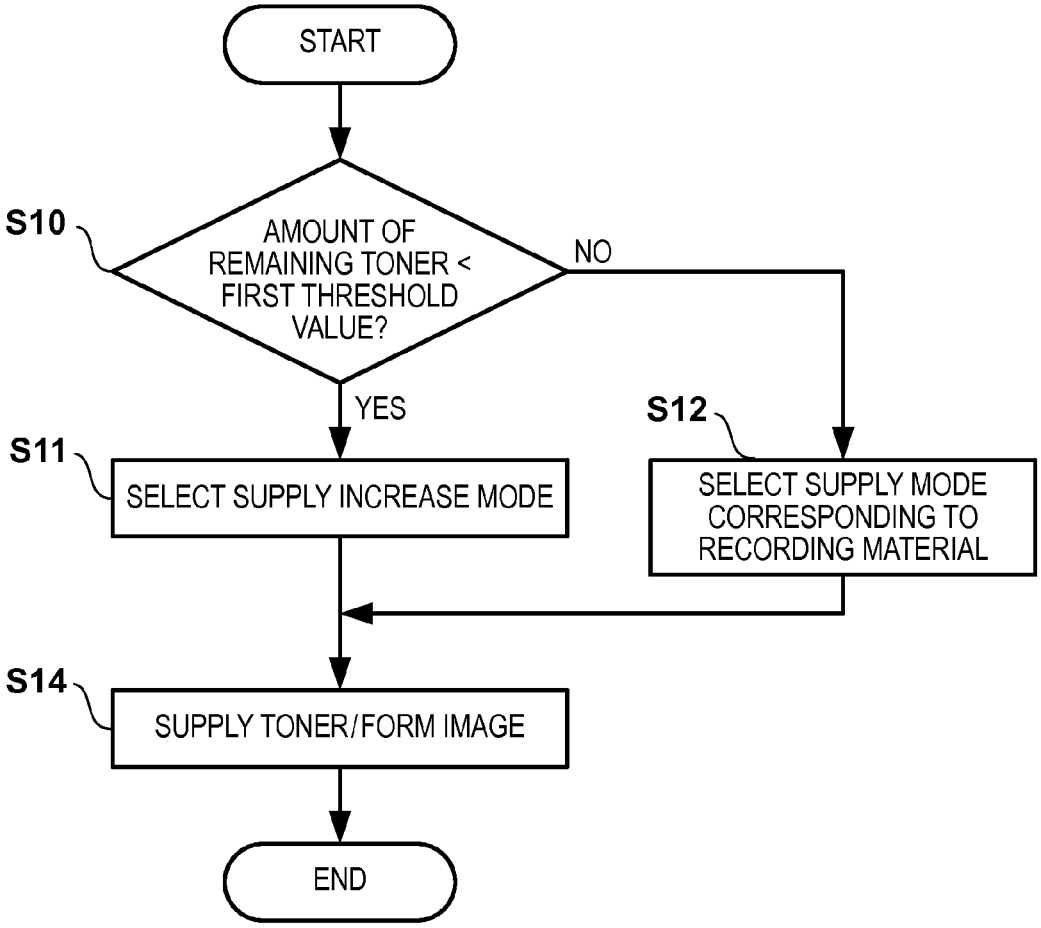
FIG. 15 is a flowchart for supply mode selection processing.

FIG. 15 shows a flowchart of control processing for the toner supply mode according to the present embodiment. The control unit 26 determines whether or not the amount of toner remaining on the developing units of the process cartridges 9*a* to 9*d* that are to be used for the formation of the supplying toner image 100 is below a first threshold value in step S10, and if it is not below the first threshold value, in step S12, the control unit 26 executes the toner supply mode that corresponds to the type of recording material that is to be used. On the other hand, if the amount of toner remaining in step S10 is less than the first threshold value, in step S11, the control unit 26 selects the supply increase mode as the toner supply mode, regardless of the type of recording material that is to be used. Then, in step S14, the control unit 26 performs the formation of the supplying toner image and the formation of the image that is to be printed. Note that the developing units that are used in the formation of the supplying toner image 100 can use any suitable criteria, similarly to the first embodiment. Note that in the case of using multiple colors in the formation of the supplying toner image 100, a configuration is possible where the supply increase mode is selected if even one of the colors to be used is below the first threshold value for example. Also, a configuration is possible where the supply increase mode is selected if all of the colors to be used are below the first threshold value. Furthermore, a configuration is possible where the supply increase mode is selected if a predetermined number or more of the colors to be used are below the first threshold value, or if more than half of the colors to be used are below the first threshold value.

Figure 16A:
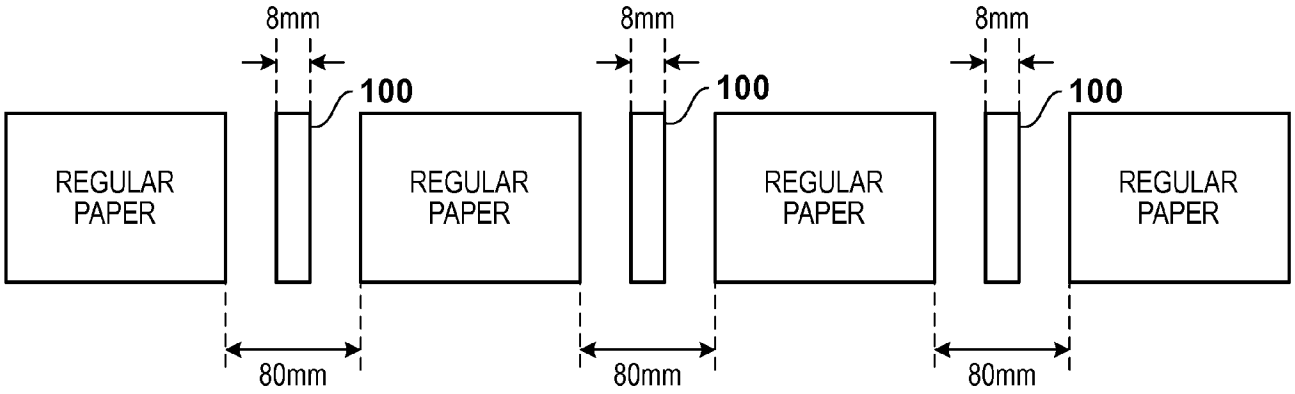
FIGS. 16A and 16B are diagrams showing exemplary recording materials and supplying toner images according to an embodiment.
Figure 16B:
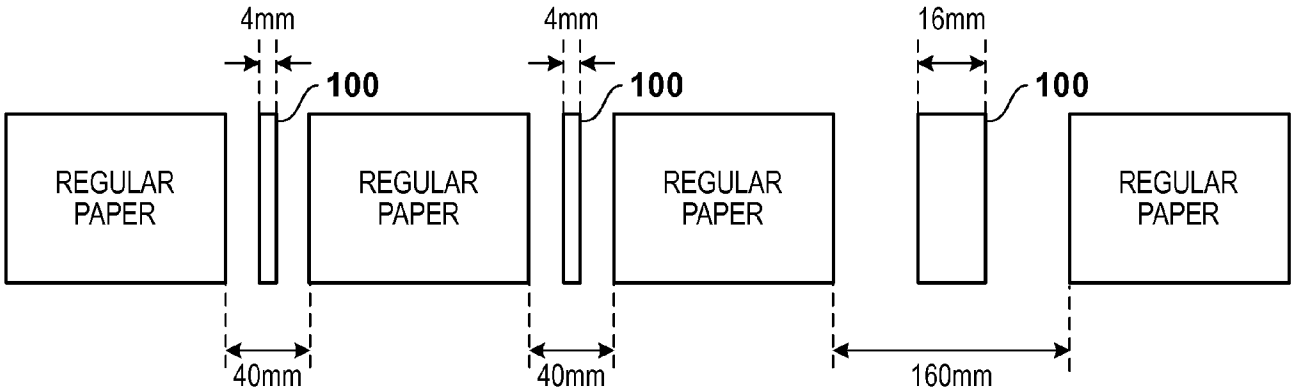

In the example shown in FIG. 10, if the regular paper mode continues to be executed when the amount of toner remaining in the process cartridge is less than 10%, there is a large possibility that a cleaning defect will occur. For example, by setting the threshold value in step S10 of FIG. 15 to 10% and increasing the toner supply amount in the supply increase mode to 0.70 mg as shown in FIG. 14, it is possible to maintain favorable cleaning performance. Note that the numerical values in FIG. 10 and FIG. 14 are examples and the present invention is not limited to the numerical values in FIG. 10 and FIG. 14. Also, although it was determined that the end of the lifetime of the cartridge is near based on the remaining toner amount, it is also possible to determine this using another value that changes according to the use of the developing units 8*a* to 8*d*, such as the number of rotations or the time of rotation of a developing sleeve. Furthermore, in the supply increase mode, the length of the non-forming region and the length of the supplying toner image were fixed. In other words, in the case of printing on regular paper in the supply increase mode in accordance with the example in FIG. 14, the length of the non-forming region and the length of the supplying toner image are as shown in FIG. 16A. However, an embodiment is possible in which the length of the non-forming region and the length of the supplying toner image according to the type of recording material are used and periodically changed into the length of the non-forming region and the length of the supplying toner image 100 of the supply increase mode. In such a case, if printing on regular paper in the supply increase mode for example, the lengths are as shown in FIG. 16B.

As described above, it is possible to achieve an improvement in cleaning performance and a reduction in underside smearing in the present embodiment, regardless of the usage period of the process cartridges 9*a* to 9*d*.

Fourth Embodiment

A fourth embodiment will be described next focusing on the differences from the first embodiment. FIG. 17 shows various conditions for various types of recording materials in the present embodiment. The difference between the present embodiment and the first embodiment is that a small amount mode has been added for regular paper. Note that the regular mode for regular paper in the present embodiment is the same as the regular paper mode in the first embodiment, and in the small amount mode, the amount of toner per unit area is decreased to an amount that is lower than that in the regular mode (regular value). Note that in the present embodiment, the amount of toner per unit area in the small amount mode is half the regular value. In the present embodiment, the control unit 26 stores the integrated amount of toner that needs to be supplied to the cleaning unit 27 and the integrated amount of toner that has been supplied at the current point in time. Note that the integration can be started when starting to use the process cartridges, for example. In the present embodiment, if the type of recording material that is to be printed on is regular paper, it is determined whether or not a value obtained by subtracting the integrated amount of toner that needs to be supplied from the integrated amount of toner that has been supplied at the current point in time is greater than or equal to a second threshold value. If it is greater than or equal to the second threshold value, it is determined that a sufficient amount of toner has been supplied to the vicinity of the cleaning unit 27, and the small amount mode is selected.

In this way, by performing control, it is possible to reduce underside smearing on regular paper, which has a narrow non-forming region, while maintaining cleaning performance. Note that the numerical values shown in FIG. 17 are examples.

Other Embodiments

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-275097, filed on Dec. 17, 2012, which is hereby incorporated by reference herein in its entirety.

What is claimed is:

1. An image forming apparatus comprising:

an image forming unit configured to form a developer image on an image carrier using a developer;

a transfer unit configured to transfer the developer image formed on the image carrier to a recording material;

a removal unit configured to remove developer that was not transferred to the recording material and remains on the image carrier; and a control unit configured to, in order to supply developer to the removal unit, control the image forming unit such that a supplying developer image that is not to be transferred to the recording material is formed on a region of the image carrier that is between developer images that are to be transferred to the recording material, wherein the control unit is further configured to control the image forming unit such that a length of the supplying developer image in a sub-scanning direction is varied depends on a type of the recording material, on which the developer image is transferred before or after the supplying developer image is transferred.

2. The image forming apparatus according to claim 1, wherein an amount of developer per unit area of the supplying developer image is determined such that the developer in the supplying developer image that is attached to the recording material via the transfer unit is less than or equal to a predetermined amount.

3. The image forming apparatus according to claim 1, wherein the image forming unit is further configured to form at least one first supplying developer image and at least one second supplying developer image as the supplying developer image, wherein a length of the second supplying developer image in the sub-scanning direction is longer than that of the first supplying developer image, and an amount of developer per unit area of the second supplying developer image is less than or equal to an amount of developer per unit area of the first supplying developer image, and wherein an amount of developer supplied to the removal unit by the second supplying developer image is greater than or equal to an amount of developer supplied to the removal unit by the first supplying developer image.

4. The image forming apparatus according to claim 1, wherein the image forming unit is further configured to form at least one first supplying developer image and at least one second supplying developer image as the supplying developer image, wherein a length of the second supplying developer image in the sub-scanning direction is longer than that of the first supplying developer image, and an amount of developer per unit area of the second supplying developer image is less than or equal to an amount of developer per unit area of the first supplying developer image, and wherein the control unit is further configured such that when there is at least a predetermined number of image forming units used for forming a supplying developer image in which a remaining amount of developer is less than a first threshold amount, then the control unit causes the second supplying developer image to be formed regardless of the type of the recording material.

5. The image forming apparatus according to claim 1, wherein the image forming unit is further configured to be able to form at least one first supplying developer image and at least one second supplying developer image as the supplying developer image, wherein a length of the second supplying developer image in the sub-scanning direction is longer than that of the first supplying developer image, and an amount of developer per unit area of the second supplying developer image is less than or equal to an amount of developer per unit area of the first supplying developer image, and wherein the control unit is further configured to, if the first supplying developer image is formed, compare an integrated amount of developer that needs to be supplied to the removal unit and an integrated amount of developer that was supplied to the removal unit, and if the integrated amount of developer that was supplied to the removal unit is larger than the integrated amount of developer that needs to be supplied, reduce the amount of developer per unit area of the first supplying developer image to less than a regular value.

6. The image forming apparatus according to claim 5, wherein the control unit is further configured to, if the difference between the integrated amount of developer that needs to be supplied and the integrated amount of developer that was supplied is greater than a second threshold value, reduce the amount of developer per unit area of the first supplying developer image to less than the regular value.

7. The image forming apparatus according to claim 5, wherein the control unit is further configured to, in the case where the amount of developer per unit area of the first supplying developer image was reduced to less than the regular value, when the integrated amount of developer that was supplied equals the integration amount of developer that needs to be supplied, return the amount of developer per unit area of the first supplying developer image to the regular value.

8. The image forming apparatus according to claim 1, wherein the control unit is further configured to control the image forming unit to form the supplying developer image such that an amount of developer per unit area of the supplying developer image decrease as the length of the supplying developer image in the sub-scanning direction increases.

9. An image forming apparatus comprising:

an image forming unit configured to form a developer image on an image carrier using a developer;

a transfer unit configured to transfer the developer image formed on the image carrier to a recording material;

a removal unit configured to remove developer that was not transferred to the recording material and remains on the image carrier; and a control unit configured to, in order to supply developer to the removal unit, control the image forming unit such that a supplying developer image that is not to be transferred to the recording material is formed on a region of the image carrier that is between developer images that are to be transferred to the recording material, wherein the control unit is further configured to, in accordance with a size of the region of the image carrier that is between the developer images that are to be transferred to the recording material, control a size of the supplying developer image such that an amount of developer per unit area is not more than a predetermined amount.

10. The image forming apparatus according to claim 9, wherein the control unit is further configured to control the image forming unit to form the supplying developer image such that the amount of developer per unit area of the supplying developer image decrease as a length of the supplying developer image in a sub-scanning direction increases.

11. The image forming apparatus according to claim 9, wherein the amount of developer per unit area of the supplying developer image is determined such that the developer in the supplying developer image that is attached to the recording material via the transfer unit is less than or equal to a predetermined amount.

12. The image forming apparatus according to claim 9, wherein the image forming unit is further configured to form at least one first supplying developer image and at least one second supplying developer image as the supplying developer image, wherein a length of the second supplying developer image in a sub-scanning direction is longer than that of the first supplying developer image, and an amount of developer per unit area of the second supplying developer image is less than or equal to an amount of developer per unit area of the first supplying developer image, and wherein an amount of developer supplied to the removal unit by the second supplying developer image is greater than or equal to an amount of developer supplied to the removal unit by the first supplying developer image.

13. The image forming apparatus according to claim 9, wherein the image forming unit is further configured to form at least one first supplying developer image and at least one second supplying developer image as the supplying developer image, wherein a length of the second supplying developer image in a sub-scanning direction is longer than that of the first supplying developer image, and an amount of developer per unit area of the second supplying developer image is less than or equal to an amount of developer per unit area of the first supplying developer image, and wherein the control unit is further configured such that when there is at least a predetermined number of image forming units used for forming the supplying developer image in which a remaining amount of developer is less than a first threshold amount, then the control unit causes the second supplying developer image to be formed.

14. The image forming apparatus according to claim 9, wherein the image forming unit is further configured to be able to form at least one first supplying developer image and at least one second supplying developer image as the supplying developer image, wherein a length of the second supplying developer image in a sub-scanning direction is longer than that of the first supplying developer image, and an amount of developer per unit area of the second supplying developer image is less than or equal to an amount of developer per unit area of the first supplying developer image, and wherein the control unit is further configured to, if the first supplying developer image is formed, compare an integrated amount of developer that needs to be supplied to the removal unit and an integrated amount of developer that was supplied to the removal unit, and if the integrated amount of developer that was supplied to the removal unit is larger than the integrated amount of developer that needs to be supplied, reduce the amount of developer per unit area of the first supplying developer image to less than a regular value.

15. The image forming apparatus according to claim 14, wherein the control unit is further configured to, if the difference between the integrated amount of developer that needs to be supplied and the integrated amount of developer that was supplied is greater than a second threshold value, reduce the amount of developer per unit area of the first supplying developer image to less than the regular value.

16. The image forming apparatus according to claim 14, wherein the control unit is further configured to, in the case where the amount of developer per unit area of the first supplying developer image was reduced to less than the regular value, when the integrated amount of developer that was supplied equals the integration amount of developer that needs to be supplied, return the amount of developer per unit area of the first supplying developer image to the regular value.

* * * * *